US005950724A

United States Patent [19]

Giebeler

[11] Patent Number: 5,950,724

[45] Date of Patent: Sep. 14, 1999

[54] LIFTING TOP DRIVE CEMENT HEAD

[76] Inventor: James F. Giebeler, 3755 El Camino Dr., San Bernardino, Calif. 92404

[21] Appl. No.: 08/904,703

[22] Filed: Aug. 1, 1997

Related U.S. Application Data

[60] Provisional application No. 60/026,449, Sep. 4, 1996.

[51] Int. Cl.[6] ..... E21B 33/05

[52] U.S. Cl. ..... 166/70; 166/155; 166/156; 166/193

[58] Field of Search ..... 166/70, 90.1, 193, 166/153, 155, 156, 177.4

[56] References Cited

U.S. PATENT DOCUMENTS

| | | | |
|---|---|---|---|
| 3,616,850 | 11/1971 | Scott . | |
| 4,317,486 | 3/1982 | Harris | 166/70 |
| 4,406,485 | 9/1983 | Giebeler . | |
| 4,524,998 | 6/1985 | Brisco | 166/70 |
| 4,722,389 | 2/1988 | Arnold | 166/70 |
| 4,928,520 | 5/1990 | Barrington | 166/70 |
| 4,995,457 | 2/1991 | Baldridge | 166/70 |
| 5,095,988 | 3/1992 | Bode | 166/70 |
| 5,833,002 | 11/1998 | Holcombe | 166/70 |

OTHER PUBLICATIONS

Subsea Cementery Equipment by SJ Services, Sep. 1994.

*Primary Examiner*—William Neuder
*Attorney, Agent, or Firm*—Lyon & Lyon LLP

[57] ABSTRACT

A subsea lifting top drive cement head in which cement flows from the top. The cement head includes lower and upper assemblies with a bore for fluid flow, and a body in sure lock connection with the lower and upper assemblies and having a dart cage to prevent a dart inside the dart cage from being washed away by the cement flow. In addition, the cement head includes a ball dropper that does not need to be retracted prior to releasing the dart.

19 Claims, 8 Drawing Sheets

LIFTING TOP DRIVE CEMENT HEAD

This is a Continuation Application of a Provisional Application Ser. No. 60/026,449, filed on Sep. 4, 1996.

BACKGROUND OF THE INVENTION

1. Field of the Invention

The present invention pertains generally to the field of cementing equipment, and more particularly to a cement head apparatus used for subsea cementing operations.

2. Background

Traditionally, in the oil field industry rubber darts and/or rubber balls are used for a down hole cementing operation and are held in a cementing head up and out of the cement slurry flow path. The rubber darts and/or balls are released at the appropriate time to join into the cement flow moving down hole. FIG. 1 depicts one such traditional approach. This prior art's approach requires that the cement slurry flow into the cement head from a cement inlet on the sides. This approach works for cement heads which use a manifold system, but is saddled with several disadvantages, particularly with respect to subsea applications. First, the prior art cement heads do not have any lifting capacity or tensile strength. Second, they do not have a rotational capacity to swivel the cement flow because the slurry is flowing into them from the sides.

In subsea well drilling applications using off-shore drilling platforms or specialized drilling boats, the pipe lifting system must have the ability to simultaneously lift 750 metric tons (1,653,450 lbs.) of pipe, and have the ability to rotate at 50 rpm to assure sufficient swivel of the cement flowing into the pipes, and further have the flow capacity of up to 60 barrels per minute of cement flow at the speeds of up to 50 feet per second. Accordingly, the cement head must have the capacity to endure combined lift to pressure ratios of up to 500 metric tons at 10,000 psi working pressure. Therefore, there is a strong desire for a cement head in which cement flows into the cement head from the top and further has a high tensile strength and a capacity for swivel.

SUMMARY OF THE INVENTION

The present invention is directed to a lifting top drive cement head in which cement flows into the cement head from the top and further has a high tensile strength and a capacity for swivel. The present invention also satisfies the need for a rubber dart or staging plug which can be held in the middle of the slurry flow without being washed away or disintegrated by the slurry flow. To these ends a lifting top drive cement head of the present invention comprises upper and lower assemblies with bores for fluid flow, and a body connecting the upper and lower assemblies. The body has a bore, a dart cage mounted in its bore, and a dart inside the dart cage; wherein fluid flows from the upper assembly down to the body and from there down to the lower assembly. In some embodiments, the body further comprises a ball dropper in its side wall where the ball dropper includes a ball and a ball launching device; wherein the launching device does not extend into the bore after the ball is launched. In other embodiments, the body is in sure lock connection with the upper and lower assemblies.

Accordingly, it is one object of the present invention to provide a dart cage mounted centrally in a cement head to protect the dart within the cage from cement flow from above and angularly around it. It is a further object of the present invention to disclose a dart chamber with flow ports near its bottom end to catch a portion of the flow to help launch the dart once it is released. It is yet a further object of the present invention to disclose a cement head which has sufficient lifting capacity for subsea applications. It is another object of the present invention to disclose a cement head which has a staging rubber ball held in its side wall and a ball releasing mechanism which does not have to be retracted after operation. It is another object of the present invention to disclose a cement head with a lever flag tattle tale. It is another object of the present invention to disclose a cement head with sure lock connections which facilitate different configurations for the cement head which is capable of lifting more than 1,650,000 lbs. of hook or tensile load.

A lifting top drive cement head of the instant invention fulfills all of the above objectives. Further, a cement head of the present invention can be connected directly to the drilling swivel of the very largest off-shore oil drilling rigs in the world today.

These and other objects, features, aspects, and advantages of the present invention will become better understood with reference to the following description and accompanying drawings.

DESCRIPTION OF THE PRESENT INVENTION

Figure 1:
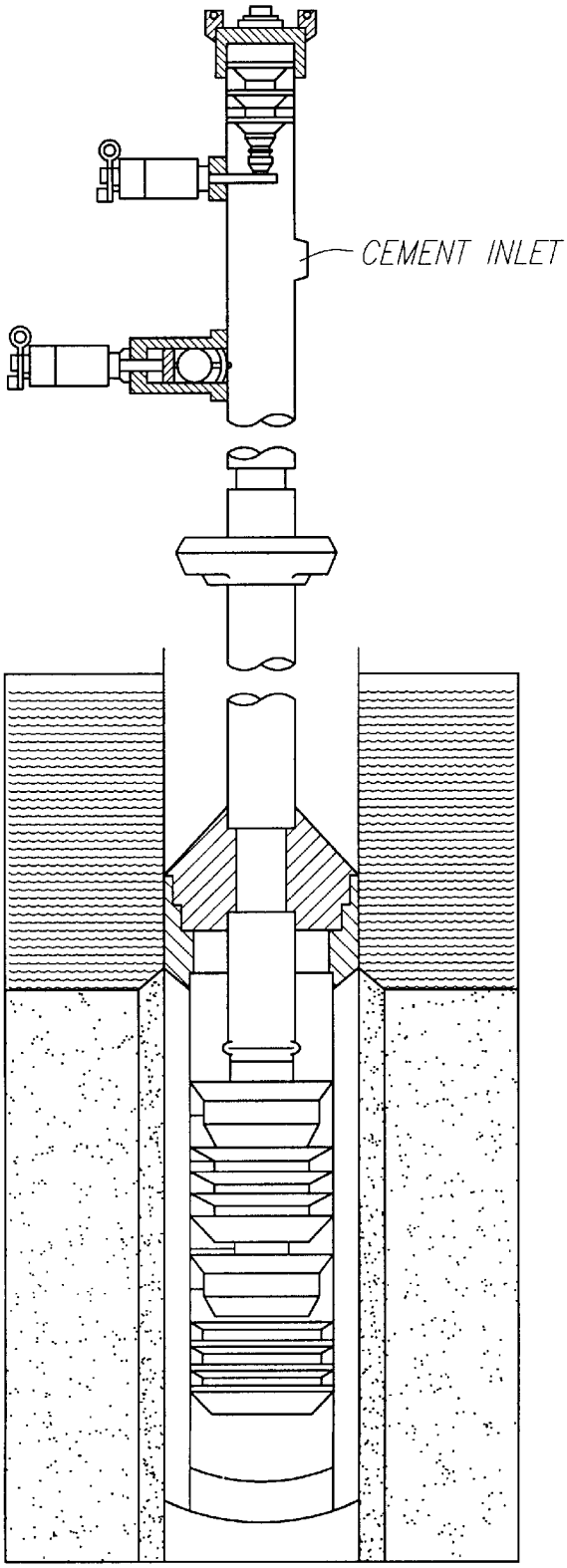
FIG. 1 (PRIOR ART)
FIG. 1 is an elevational sectional view of a cement head of prior art.
Figure 2:
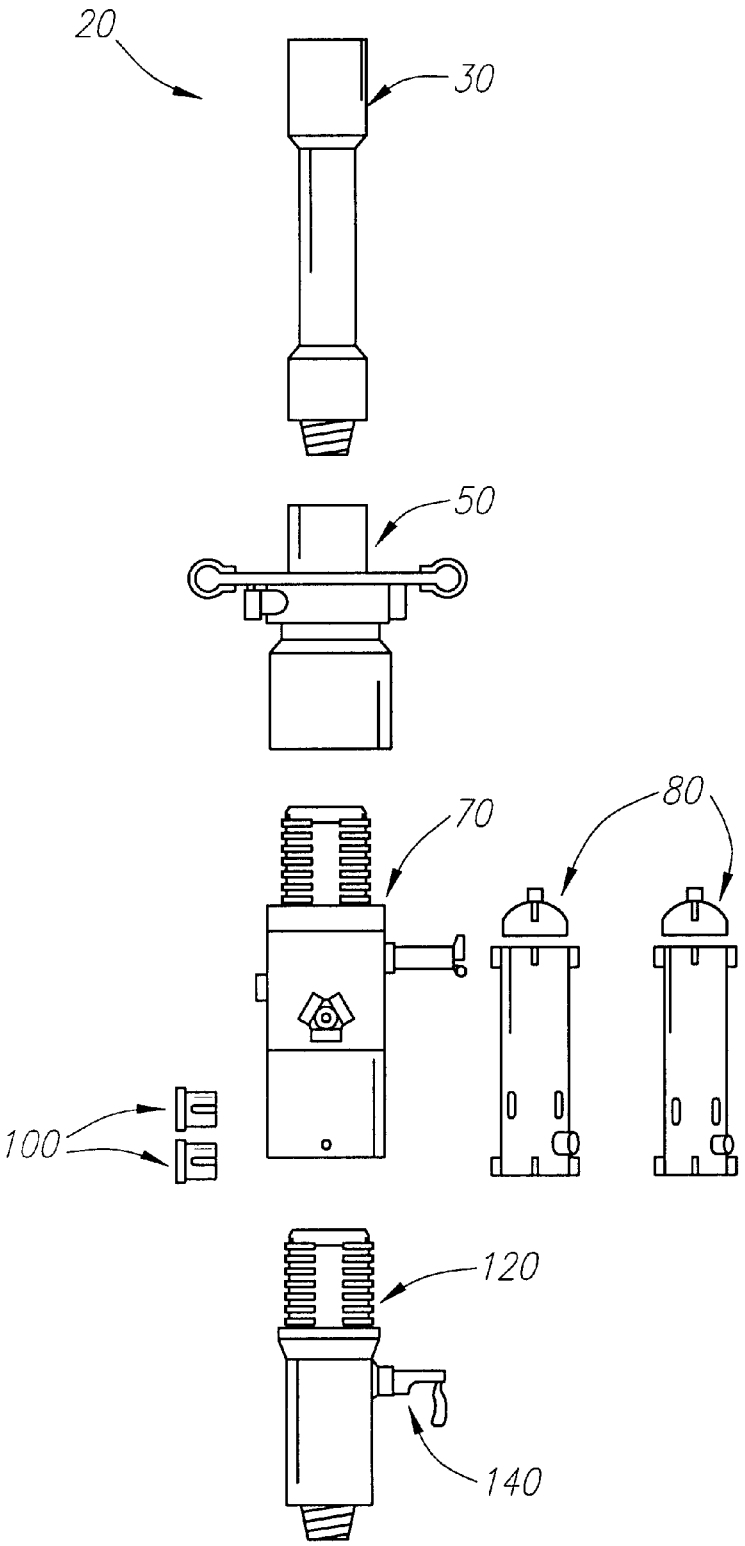
FIG. 2 is a plan view of a cement head of the present invention showing its basic components.
Figure 3:
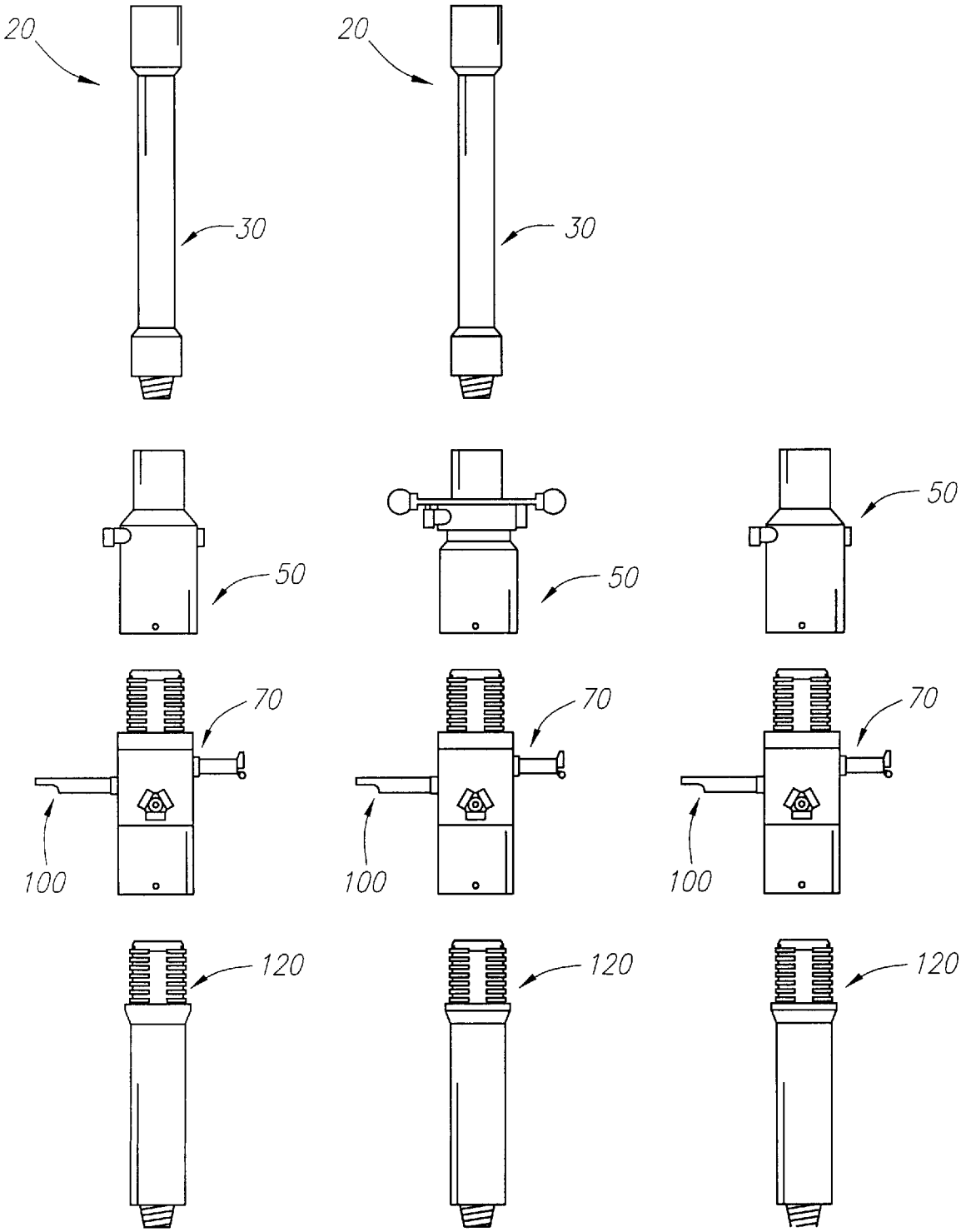
FIG. 3 is a plan view of three different embodiments of a cement head of the present invention.

Referring to the drawings, FIG. 2 shows a cement head 20 which has the following basic components: a lifting assembly 30, a swivel upper assembly 50, a body assembly 70, a dart cage 80, a ball dropper 100, a lower assembly 120, and a dart tattle tale assembly 140.

Figure 4:
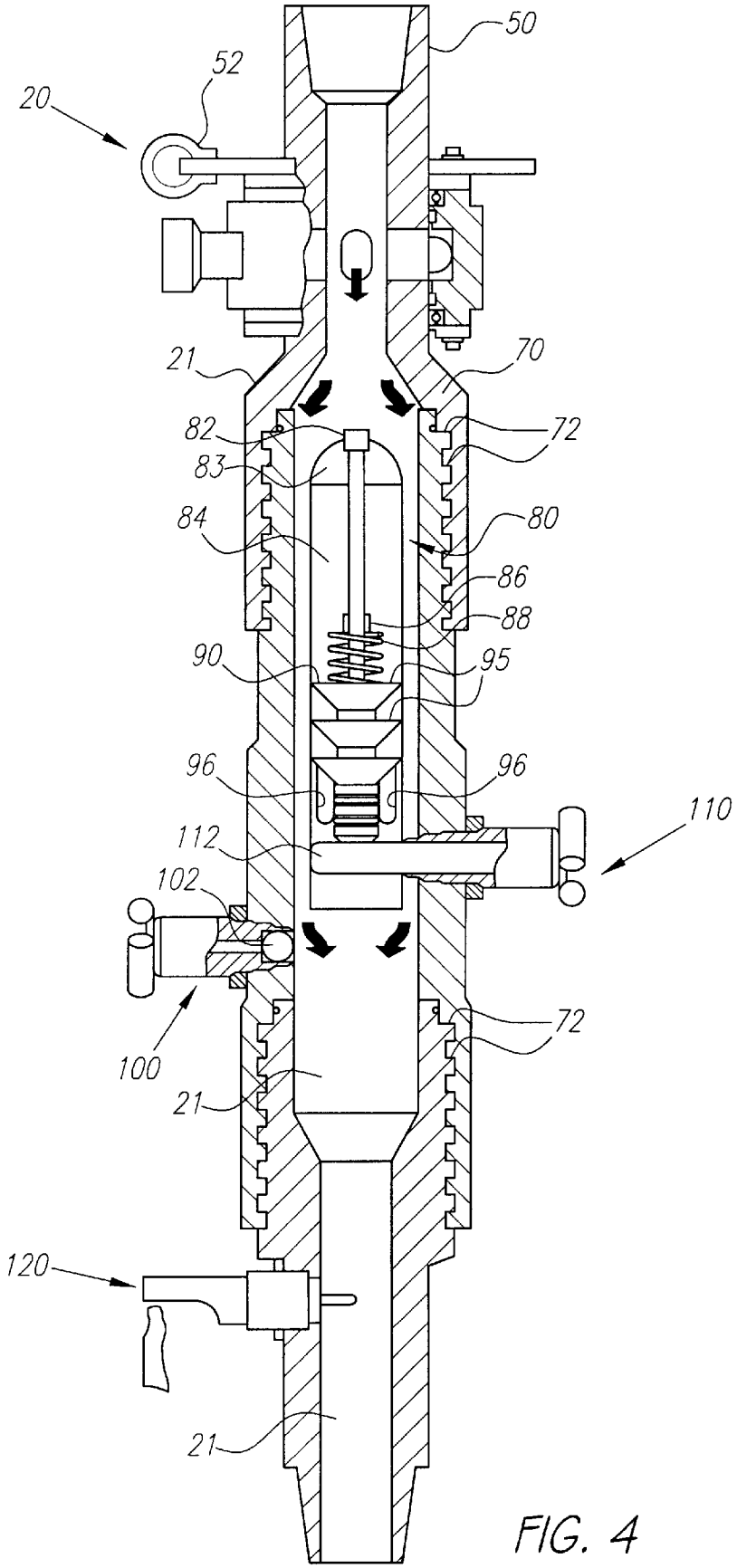
FIG. 4 is an elevational sectional view of a cement head of the present invention.

FIG. 4 illustrates one novel feature of the cement head 20 of the present invention which in its bore 21 centrally holds the dart cage 80. The dart cage 80 provides a housing for a dart 90 in order to protect the dart 90 from the cement flowing in the cement head bore 21 from the top and flowing angularly around the dart 90. The dart cage 80 is available in different sizes depending on which launching dart is being used.

As shown in FIG. 4, the dart 90 is held up in place by a dart pin 112 of about 1-½ inches in diameter which is connected to a dart screw pin puller 110. When the pin 112 is retracted by pulling the dart screw pin puller 110, the dart 90 is pushed down into the flow by a compressed spring 88. The dart cage 80 preferably uses an adjustable length standoff/spring expeller to ensure that the dart 90 is pushed into the fluid flow for launch.

Figure 5:
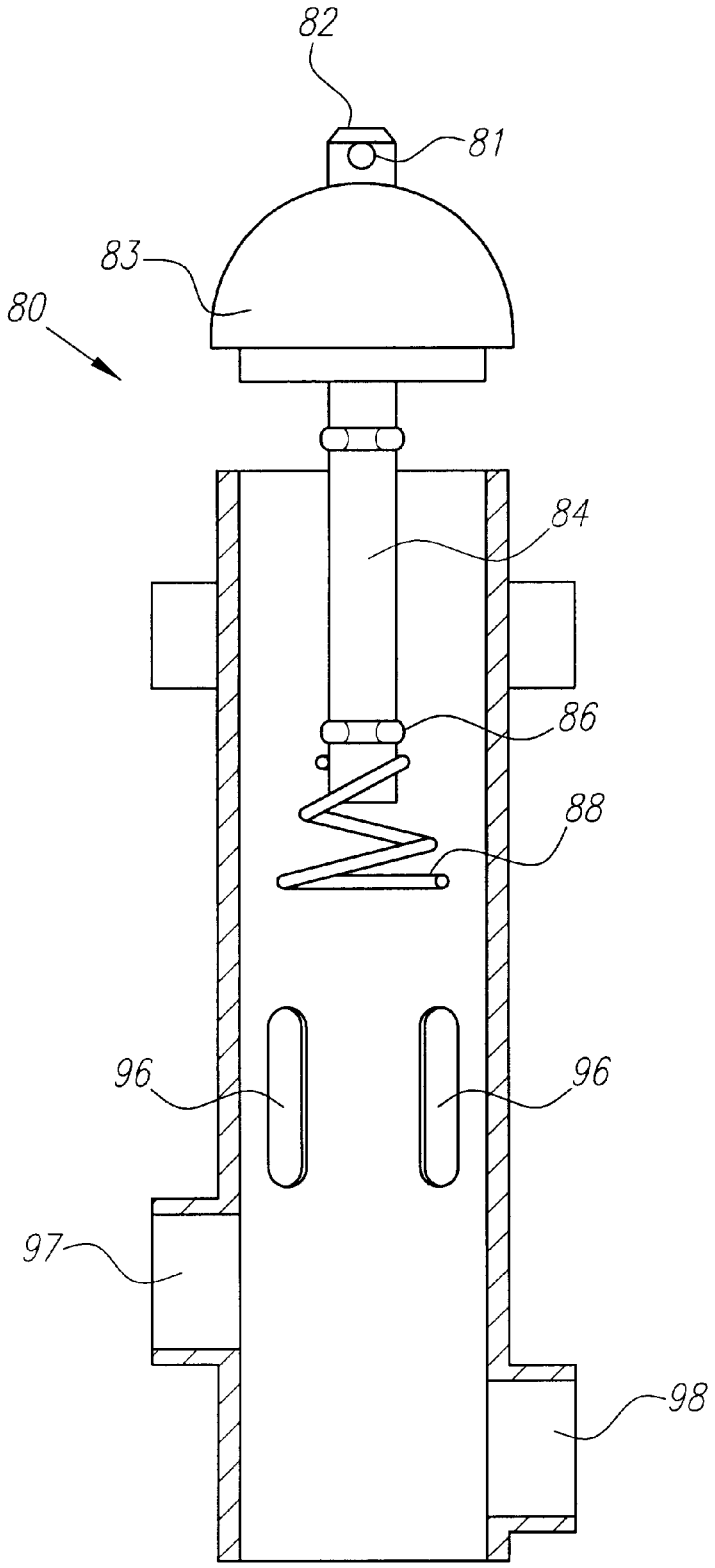
FIG. 5 is an elevational view of a dart cage assembly of the cement head in FIG. 4.

As shown in FIG. 5, in more detail, the spring 88 is attached to an extension 84 by means such as a locknut 86. The extension 84 extends from a cap 83 of the dart cage 80 and is connected thereto by means such as a locknut 82. As further illustrated in FIGS. 4 and 5, at the bottom end of the dart cage 80 are flow ports 96 which allow a portion of the annular flow to enter just below the home (rest) position of the dart's fins 95. This directed flow helps to catch the dart fins 95 and ensure dart's 90 downwardly movement. FIG. 5 also shows a hole 81 in the top portion of the cap 83 which allows for balanced pressure and gives a slight positive pressure above the dart 90.

Now, turning back to FIG. 4, the body assembly 70 is shown to have arrowhead sure lock connections 72 which allow easy assembly and/or disassembly of the cement head 20 to replace the dart 90 (from the top) inside the dart cage 80. Also, sure lock connections 72 allow easy assembly and/or disassembly of the lower sub 120 (which is about 430 lbs.) in order to eliminate the need for lifting and rotating the entire cement head 20, which could weight about 2,200 lbs. This no-weld construction contributes to the cement head's 20 simplicity, compactness and lightness. The dual sure lock connections 72 allow the operator to remove the body assembly 70 from the flow, connect the swivel upper assembly 50 to the lower sub 120, and continue operation with little downtime. The dual sure lock connections 72 also give the ability to customize jobs with minimal inventory.

Figure 6:
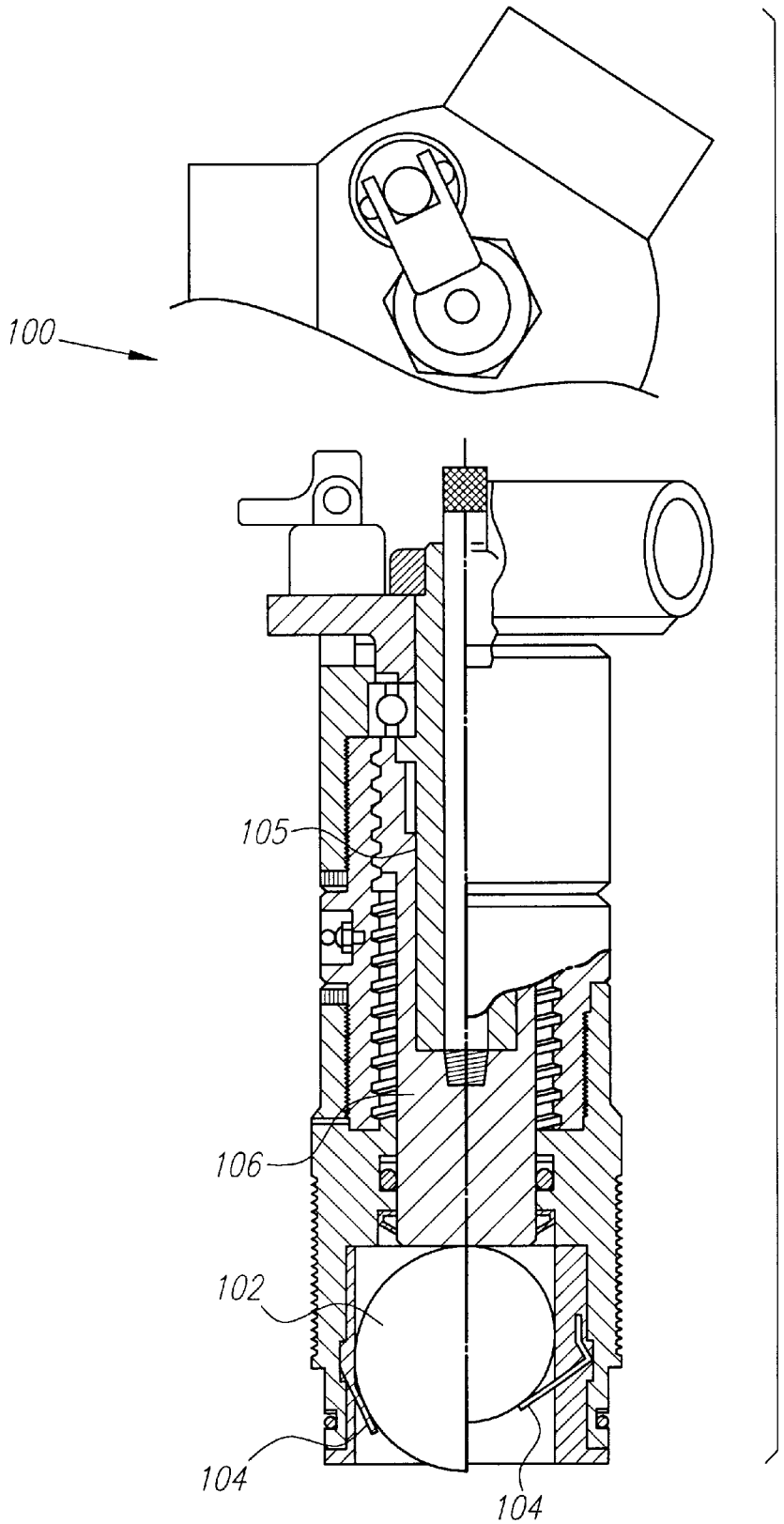
FIG. 6 is an elevational sectional view of a ball dropper of the cement head in FIG. 4.

FIG. 4 shows another novel feature of the cement head 20 of the present invention which is the ball dropper 100 which houses a ball 102 for dropping it down hole. In a preferred embodiment, the ball dropper 100 can be changed to hold a ball of different sizes. As seen in FIG. 6, the rubber ball 102 is held inside the ball dropper 100 which extends outwardly from the side wall of the cement head 20 and thus the ball 102 is kept completely out of the cement flow. The ball 102 is retained in place by spring fingers 104. To release the ball 102, a lock lever 108 connected to a bonnet assembly 110 is unlocked and the bonnet 110 is turned to move forward a drive shaft 105 connected to a pushing pin 106 to launch the ball 102 through spring fingers 104 into the cement head bore 21. The weight of the ball 102 and circulation of the cement slurry will carry the ball 102 down the bore 21.

The drive shaft 105 of the pushing pin 106 does not need to be retracted (as is the case in the prior art) because it cannot interfere with the dart passage, i.e. the bore 21. No part of the ball dropper 100 ever extends into the cement head bore 21, so the pushing pin 106 does not have to be retracted after use. Using the prior art devices, many projects have been spoiled when an operator has dropped the ball and neglected to retract the ball slide which catches the dart, keeping it from going down hole.

Turning back to FIG. 4, as it is shown, a preferred embodiment of the present invention also provides for a dart tattle tale assembly 140 positioned in the lower sub 120. The tattle tale 140 is used to indicate the passage of the dart 90 from its cage 80 down hole through the bore 21.

Figure 7:
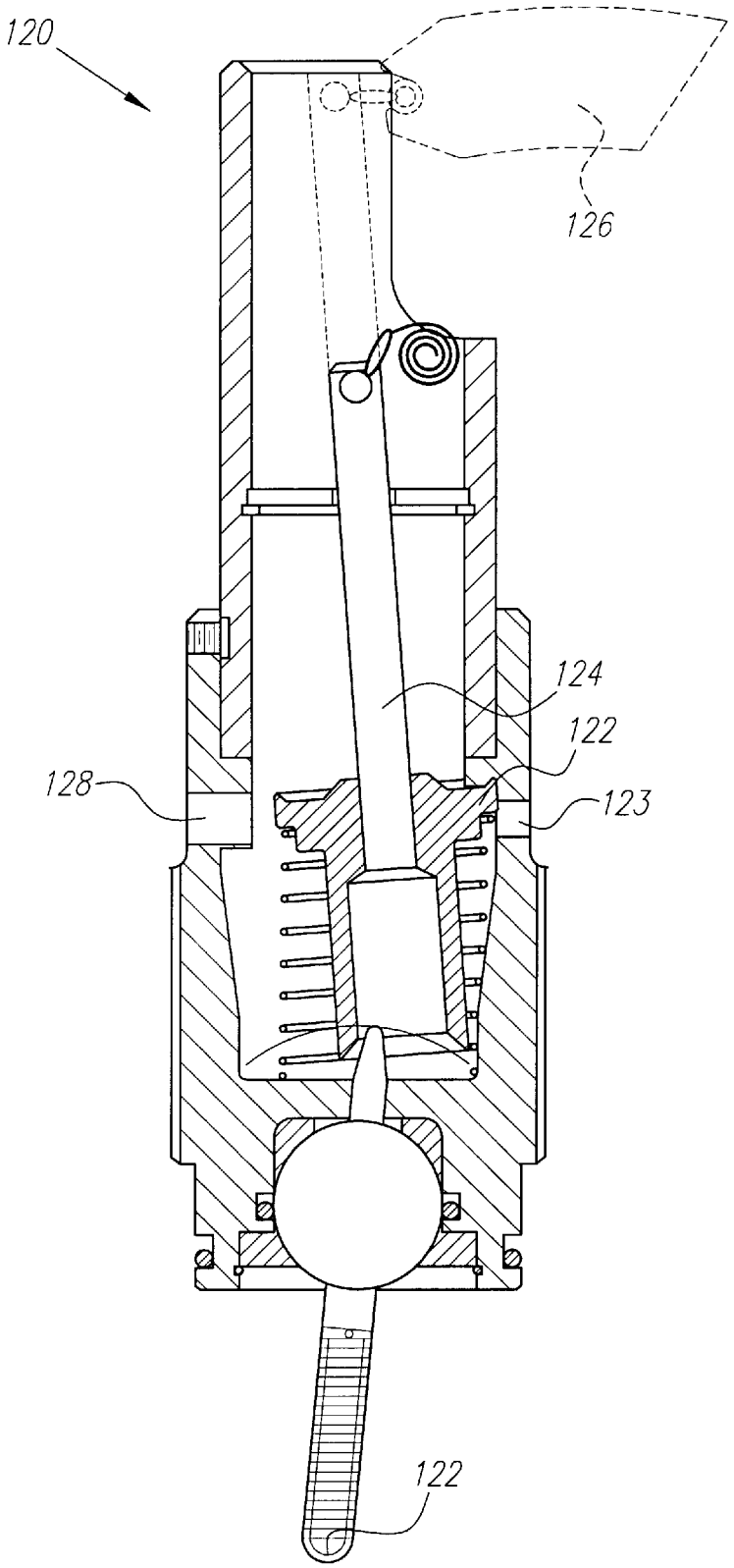
FIG. 7 is an elevational sectional view of a tattle tale of the cement head in FIG. 4.

As shown in FIG. 7, the tattle tale 120 has a lever 122 which extends into the cement head bore 21. The lever 122 unlatches and releases an indicator arm 124 when the dart 90 hits the lever 122 on the way down hole. As a result, a flag 126 rolls out of the tattle tale 120 indicating that the dart 90 has passed through. To re-cock the tattle tale 120, there is no need to remove it from the cement head 20, but simply while the indicator arm is pushed in and held, the indicator arm 124 is pushed into the latched position through a top hole 128 when a tooth 122 enters a notch 123 and then the flag 126 is rolled up into its place.

Figure 8:
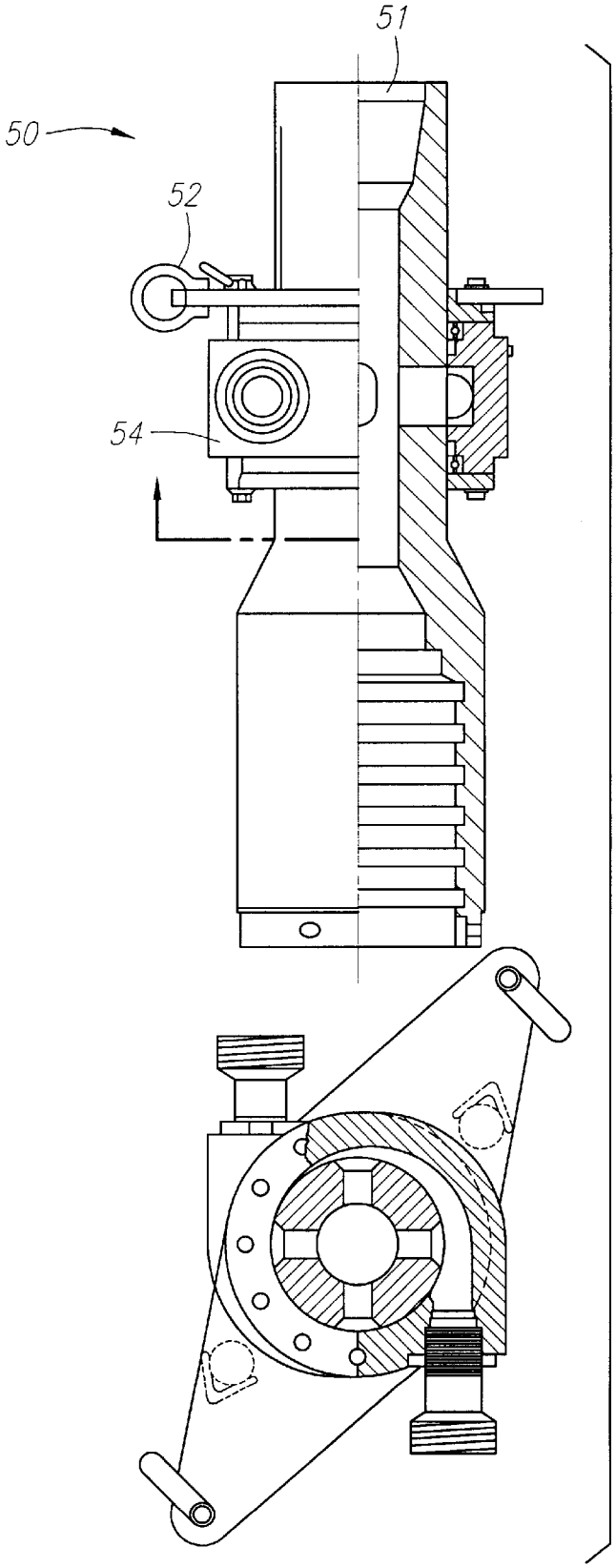
FIG. 8 is an elevational part sectional view of a swivel upper sub assembly of the cement head in FIG. 4.

FIG. 8 illustrates the swivel upper assembly 50 connected to the body assembly 70 at one end and optionally connected to the lift assembly 30 in some embodiments. In a preferred embodiment, the swivel upper assembly 50 includes a shackle ring 52. The shackle ring 52 is used to prevent the swivel body from rotating, for example by fixedly chaining the swivel upper assembly 50 through the ring 52.

Although a preferred embodiment has been shown and described, it will be apparent to those skilled in the art that many changes and modifications may be made without departing from the spirit and scope of the present invention.

What is claimed is:

1. A cement head comprising:

an upper assembly having a bore for fluid flow;

a lower assembly having a bore for fluid flow; and a body connecting said upper and lower assemblies, said body having a bore, a dart cage mounted in said bore of said body, and a dart within said dart cage;

wherein fluid flows from said upper assembly down to said body down to said lower assembly.

2. The cement head of claim 1, wherein said dart has a plurality of fins, and wherein said dart cage further has at least one port for allowing fluid to enter said cage and engage said fins in order to drive said dart downwardly.

3. The cement head of claim 1 further comprising a lift assembly connected to said upper assembly for lifting the cement head.

4. The cement head of claim 3, wherein said body further has a shackle ring to prevent said body from rotating while swivel lifting the cement head.

5. The cement head of claim 1, wherein said lower assembly has a tattle tale for detecting passage of said dart through said bore of said lower assembly.

6. The cement head of claim 5, wherein said tattle tale includes a lever with a first end extending into said bore of said lower assembly and a second end connected to a flag.

7. The cement head of claim 1, wherein said dart cage further has a cap connected to a spring holding said dart in resting position on a pin puller.

8. The cement head of claim 1, wherein said dart cage causes said fluid to flow around said dart cage before reaching said dart.

9. The cement head of claim 1 further comprising a ball dropper in a side wall of said body, said ball dropper having a ball and a ball launching device, wherein said launching device does not extend into said bore of said body after said ball is launched.

10. The cement head of claim 1, wherein said body is in sure lock connection with said upper and lower assemblies.

11. A cement head comprising:

an upper assembly having a bore for fluid flow;

a lower assembly having a bore for fluid flow;

a body connecting said upper and lower assemblies, said body having a bore for fluid flow; and a dart cage mounted in one of said bores and a dart within said dart cage;

wherein said dart cage prevents fluid from reaching said dart before said dart is released.

12. The cement head of claim 11 further comprising a ball dropper in a side wall of said body, said ball dropper having a ball and a ball launching device, wherein said launching device does not extend into said bore of said body after said ball is launched.

13. The cement head of claim 11, wherein said body is in sure lock connection with said upper and lower assemblies.

14. The cement head of claim 11, wherein said dart has a plurality of fins, and wherein said dart cage further has at least one port for allowing fluid to enter said cage and engage said fins in order to drive said dart downwardly, once said dart is released.

15. The cement head of claim 11 further comprising a lift assembly connected to said upper assembly for lifting the cement head.

16. The cement head of claim 15, wherein said body further has a shackle ring to prevent said body from rotating while swivel lifting the cement head.

17. The cement head of claim 11, wherein said lower assembly has a tattle tale for detecting passage of said dart through said bore of said lower assembly.

18. The cement head of claim 17, wherein said tattle tale includes a lever with a first end extending into said bore of said lower assembly and a second end connected to a flag.

19. The cement head of claim 11, wherein said dart cage further has a cap connected to a spring holding said dart in resting position on a pin puller.

* * * * *